US005199254A

United States Patent [19]

Badiali et al.

[11] Patent Number: 5,199,254

[45] Date of Patent: Apr. 6, 1993

[54] DEVICE FOR SEQUENTIALLY LOADING ORIENTATED TUBES ONTO THE DOFFING BELT OF A SPINNING MACHINE

[75] Inventors: Roberto Badiali, Pordenone; Amedeo Quaia, Porcia; Luciano Bertoli, Pordenone, all of Italy

[73] Assignee: Savio S.p.A., Pordenone, Italy

[21] Appl. No.: 717,934

[22] Filed: Jun. 20, 1991

[30] Foreign Application Priority Data

Jun. 27, 1990 [IT] Italy ..... 20808 A/90

[51] Int. Cl.[5] ..... D01H 9/12; D01H 3/02

[52] U.S. Cl. ..... 57/281; 57/90; 57/264; 57/266; 242/35.5 A

[58] Field of Search ..... 242/35.5 A; 57/90, 281, 57/264, 266

[56] References Cited

U.S. PATENT DOCUMENTS

| | | | |
|---|---|---|---|
| 4,566,263 | 1/1986 | Miyazaki et al. | 57/281 X |
| 4,570,865 | 2/1986 | Kawarabashi et al. | 242/35.5 A |
| 4,571,931 | 2/1986 | Kupper | 242/35.5 A X |
| 4,576,340 | 3/1986 | Aretz et al. | 242/35.5 A |
| 4,586,668 | 5/1986 | Mori | 242/35.5 A |
| 4,660,369 | 4/1987 | Konishi et al. | 57/281 |
| 4,676,061 | 6/1987 | Yamamoto | 57/90 X |
| 4,830,171 | 5/1989 | Kupper | 242/35.5 A X |
| 4,907,688 | 3/1990 | Kupper | 242/35.5 A X |

FOREIGN PATENT DOCUMENTS

| | | | |
|---|---|---|---|
| 290063 | 3/1988 | European Pat. Off. . | |
| 2538273 | 3/1977 | Fed. Rep. of Germany . | |
| 3414432 | 10/1985 | Fed. Rep. of Germany . | |
| 3532915 | 4/1987 | Fed. Rep. of Germany . | |
| 1302787 | 7/1962 | France . | |
| 2084639 | 12/1971 | France . | |
| 2605650 | 4/1988 | France . | |
| 22788/A89 | 12/1989 | Italy . | |
| 0093185 | 4/1987 | Japan | 242/35.5 R |

*Primary Examiner*—John M. Jillions
*Assistant Examiner*—William Stryjewski
*Attorney, Agent, or Firm*—Shea & Gould

[57] ABSTRACT

A device for sequentially loading tubes onto pegs on the doffing belt of a spinning machine having a tube orienting system which includes a duct for guiding the fall of the tubes, and a mobile dispenser comprising a plurality of compartments which receive the tubes from the duct load each from the duct and also load each tube onto the pegs of the doffing belt.

11 Claims, 2 Drawing Sheets

FIG. 1A
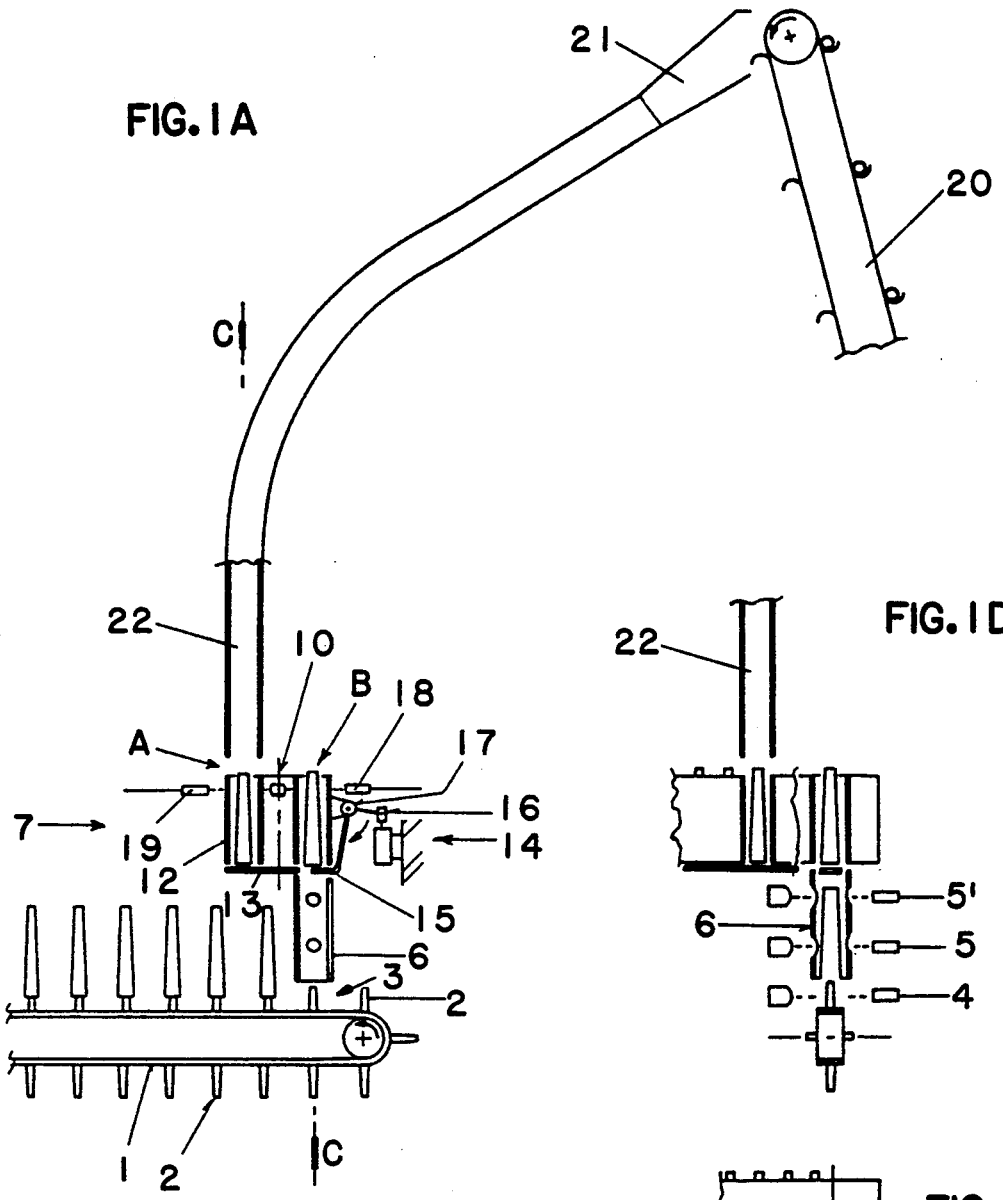
FIG. 1D
FIG. 1C
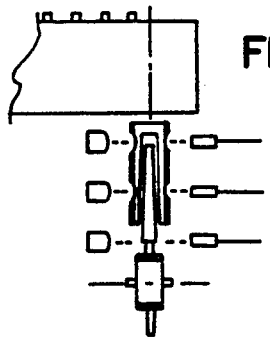
FIG. 1B
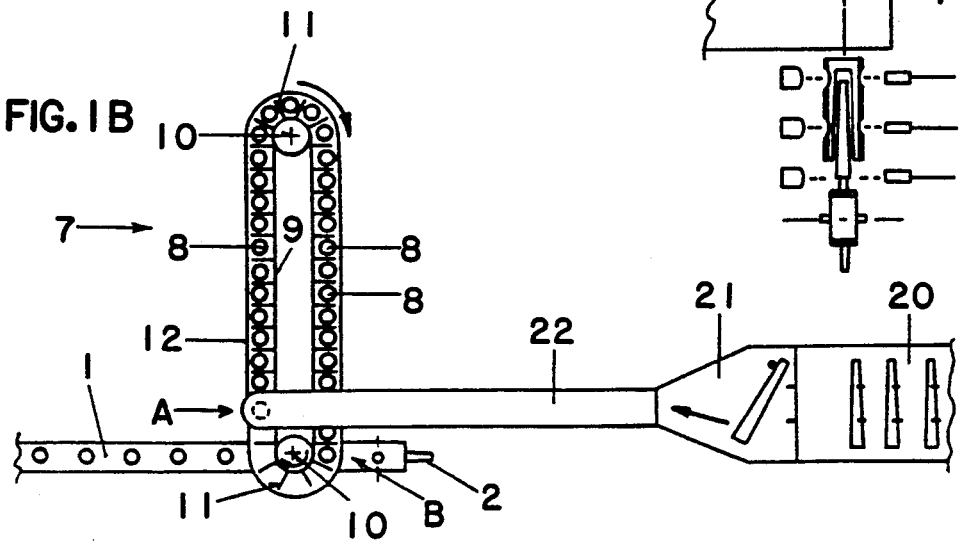

DEVICE FOR SEQUENTIALLY LOADING ORIENTATED TUBES ONTO THE DOFFING BELT OF A SPINNING MACHINE

BACKGROUND OF THE INVENTION

This invention relates to spinning devices and in particular to ring spinning devices, in which the produced yarn is wound in the form of packages onto generally conical tubes which form the package core.

The yarn packages are completed at a predetermined wound length and are then fed to the next process, generally winding, in which the produced yarn is rewound to remove defects and improve product quality, and to produce larger-sized bobbins, the empty tubes being returned to the spinning stage for their reuse.

The empty tubes and produced packages are conveyed within the spinning machine by conveyors currently known as doffing belts, on which erect positioning pegs are provided for the tubes and packages, these pegs being either fixed to the belt surface in a perpendicular position or based on discs disposed on the belt. The spinning machine doffing members deposit the finished packages to be removed from the spinning machine onto the doffing belt and withdraw empty tubes from other positions of the belt to reposition them in the spinning stations to again wind new yarn onto them to form new packages.

European patent application No. 88200602 of the present applicant describes gripping members for doffing the packages and tubes. At one end of the belt there is an empty tube loading station in which the belt presents the pegs for filling with the tubes to be returned to the spinning stations for the next doffing operation. These tubes may be either new tubes taken from the tube store, or tubes which were emptied during the winding stage following the spinning stage, and recycled.

As spinning machines of recent design comprise a large number of spinning stations, perhaps one thousand or more, and considering that the packages are doffed either all together or in groups at the same moment, the doffing operation may require the unloading of one thousand or more packages simultaneously and the repositioning of one thousand or more empty tubes, which then have to be reinstated within the required time on the doffing belt.

SUMMARY OF THE INVENTION

The present invention provides a device for reinstating the empty tubes on the doffing belt so as to make them available to the spinning stations for the next doffing operation.

BRIEF DESCRIPTION OF THE DRAWINGS

The device and method for feeding empty tubes onto the vertical pegs of the doffing belt according to the invention is described with reference to a typical embodiment shown in the drawings by way of non-limiting example wherein:

FIG. 1A is a general side elevational view of one embodiment of the invention.

FIG. 1B is a plan view of FIG. 1A embodiment.

FIG. 1C is a detailed view of the guide member illustrated in FIG. 1A embodiment.

FIG. 1D is a detailed view of the mobile store illustrated in FIG. 1A.

DESCRIPTION OF THE PREFERRED EMBODIMENTS

Figure 2A:
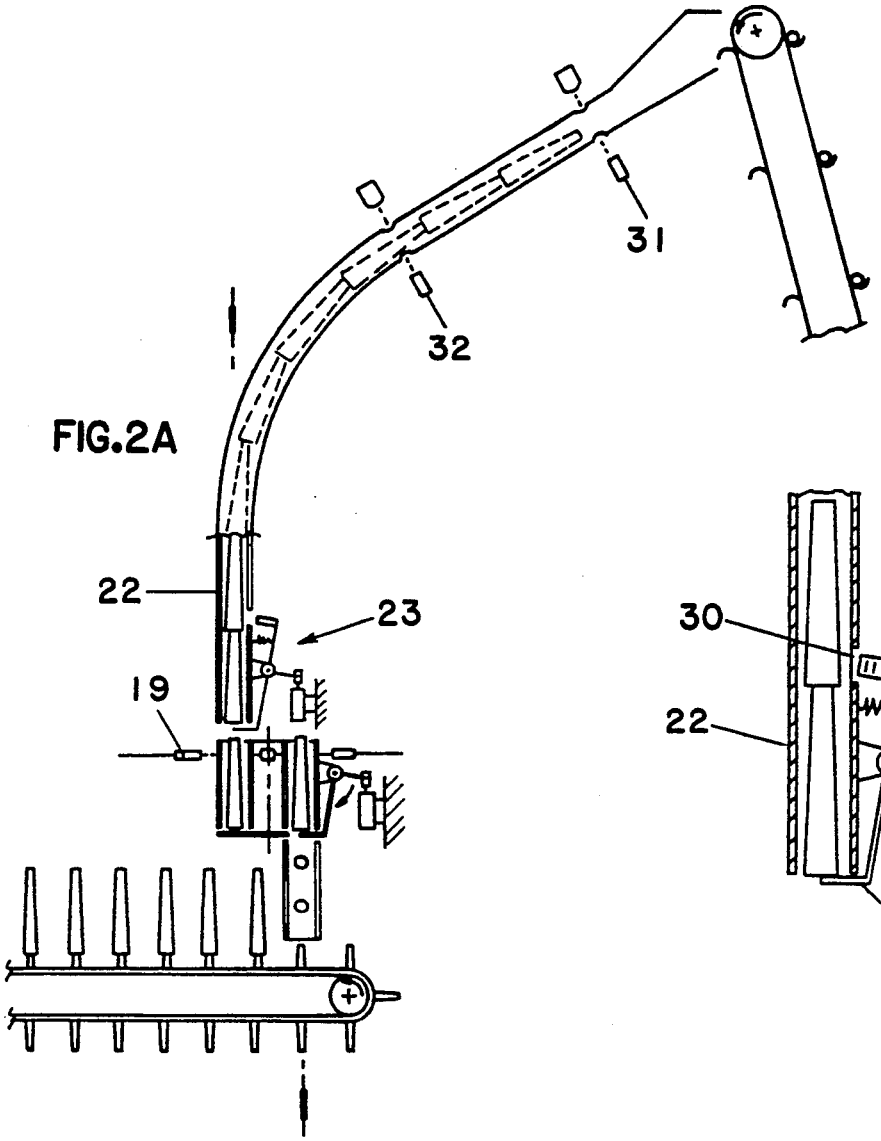
FIG. 2A is a general side elevational view of another embodiment of the invention.

Referring to the drawings and first to FIGS. 1A–1D, the conveyor belt 1 provided with pegs 2 for positioning the tubes to be fed moves stepwise towards the left to present in the tube loading position 3 those pegs on which the tube under reinstatement is to be positioned. If one tube is to be positioned every two pegs the advancement pitch of the belt 1 must correspond to the distance between the two intended receiving pegs. If however a tube is to be positioned on all the pegs the pitch corresponds to the distance between two adjoining pegs.

In position 3 there are three sensors, such as photoelectric cells 4, 5 and 5', the first of which—in the lower position—senses whether the peg has been presented in the correct position to receive the tube. The tube loading operation is dependent on its enabling by the sensor 4.

After the loading operation the sensors 5 and 5' jointly determine when the tube has been loaded, to enable the doffing belt to undergo the next step and present the next peg for the next loading of a further tube.

If there is no tube present on the peg, the sensors 5 and 5' both receive the returning signal, however if the tube is present and correctly engaged on the peg the lower sensor 5 does not receive the returning signal (intercepted by the tube) whereas the upper sensor 5' receives it (the tube does not intercept it), but if the tube has not been properly lowered onto its peg and remains raised neither of the sensors receives returning signals (the tube intercepts them both).

In position 3 there is preferably a guide member 6 open in the direction of movement of the belt to accompany the tube during its fall onto the peg.

Above this member there is disposed a mobile store 7 for the tubes to be fed to the spinning machine. It has a plurality of mobile compartments 8 formed by a belt 9 which circulates with stepwise movement between two rotating rollers 10 of vertical axis, and is provided with vanes 11 which separate said compartments 8.

As the rollers 10 rotate the compartments 8 travel along the mobile store, carrying with them the tubes located within them. The outer walls 12 and base wall 13 of the store are fixed. The mobile store receives the tubes in position A, these being transferred to the doffing belt by a device 14 when in position B, in which an aperture is provided in the base 13.

Said device 14 has a mobile shutter 15, which is kept constantly closed and is opened only by a control member the operation of which depends on the sensor 4 having determined that a peg 3 is present and ready to receive the tube. In this case an opening control member, such as a pneumatic cylinder 16, rotates the shutter 15 pivoted at 17, to uncover the aperture in the base 13 and allow the tube to fall onto its peg, after which it recloses.

The return can be determined by an elastic member such as a spring, which is loaded by the action of the opening control device and which returns the shutter to its closed position as soon as said control device ceases to act.

Sensors 18 and 19 determine the absence or presence of tubes in the compartments in position B and A respectively, to cause the mobile store to move through one step and a new tube to be loaded in position A. Thus a new tube is loaded into the mobile store in position A for each tube discharged from position B.

The upper part of the device comprises members 20 for raising the empty tubes from the tube store and/or from the recycle tube conveyor, and members 21 for orientating them, in the case of conical tubes, with their larger-diameter end to the front. These devices are for example described in Italian patent application No. 22788 A/89 of the present applicant. Said tubes are fed one at a time by the members 20 and 21 to the collection hopper which forms the initial part of the vertically or at least steeply positioned tubular duct 22, which guides the tubes during their gravity descent to the loading position A at the mobile store 7.

The duct 22 is shaped in such a manner as to contain the tubes and guide them in sequence during their decent, without them jamming, the duct preferably extending through a large radius of curvature and having a diameter which is slightly greater than, and indicatively between 1.2 and 1.8 times, that of the major diameter of the tube.

The conveyor 20 also moves stepwise to deliver one tube at a time to the orientating device 21 and to the duct 22 when the sensor 19 senses the presence of its empty compartment.

The duct 22 can be constructed simply and economically of a natural or synthetic polymer material such as transparent plastic material, thus allowing visual monitoring of its proper operation and providing good adherence for gently locking the tube column. This construction also makes it easier to mount the device and to centre it about the tube receiving position 3.

In the embodiment described heretofore the duct 22 is traversed by a single tube at a time, however other embodiments of the invention are possible.

Another embodiment is described hereinafter with reference to FIGS. 2A–2C in which the duct 22 is traversed by several tubes simultaneously.

At the lower end of the duct 22 there is a tube dispensing member 23 for loading an individual tube into each compartment presented by the store 7 in position A.

Figure 2C:
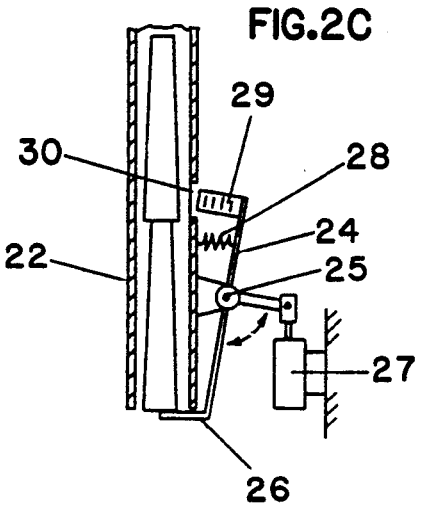
FIG. 2C is a detailed view of the lever illustrated in FIG. 2A.
Figure 2B:
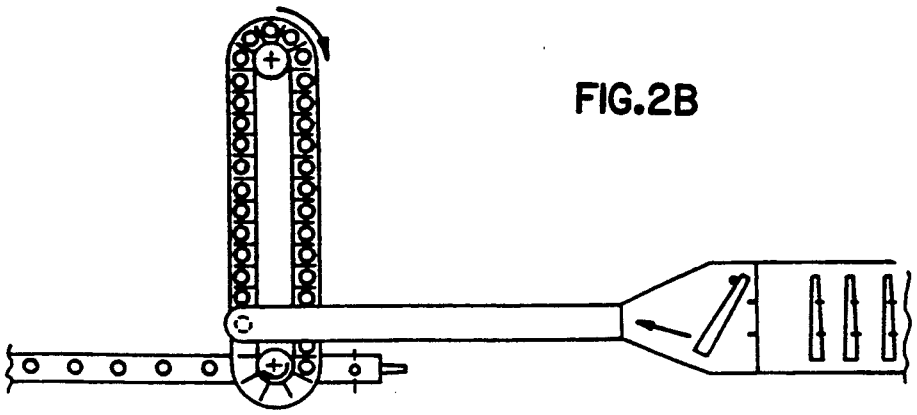
FIG. 2B is a plan view of FIG. 2A.

In the embodiment shown by way of example in the enlarged detail of FIG. 2C, this includes a lever 24 having a fulcrum 25 and able to assume positions in which the duct 22 is open, or is closed by the shutter 26, which either leaves the exit of the duct 22 free or intercepts it.

The lever 24 can be operated by means known in the art, for example comprising a rotating cam-shaped profile or a pneumatic cylinder 27, which operate in the sense of opening the shutter 26 against a return spring 28 which tends to keep it closed. On the rocker lever 24 at the end distant from the shutter 26 there is provided a member 29 which obstructs the fall of the penultimate tube by penetrating through a slot 30 in the duct 22 to engage said tube and lock it against the duct wall, so halting the overlying column of tubes. The end part of the member 29 can be formed from a soft material with good adherence characteristics such as rubber or plastics, to prevent damaging the tubes and to reliably retain them.

Each time the shutter 26 is opened a single tube is deposited if enabled by the sensor 19, the column of tubes being allowed to advance through one step downwards only when the shutter 26 has been reclosed.

Sensors 31 and 32, such as photoelectric cells, are positioned in the top of the duct 22 to control the filling of the duct 22 with tubes to be fed to the mobile store. The upper sensor 31 controls the maximum allowable tube stacking level and the lower sensor 32 controls the minimum level. This arrangement results in considerable advantages in the tube reinstatement operation. When the level of the stack falls below the minimum level the system comprising the raising member 20 and orientating member 21 is operated to reinsert tubes into the duct 22 until the maximum level is reached.

When this level is exceeded these members are halted. The stepping rate of the mobile store is made faster than that of the doffing belt of the spinning machine and so is also the rate of the raising/orientating system to be able to accommodate random empty positions in this latter without introducing delays in the reinstatement of the tubes at the doffing band while always maintaining the available positions in the mobile store filled with tubes.

With the device according to the invention the tube loading rate is substantially faster as the feed rate of the raising device 20 and the loading rate at the doffing belt are substantially independent. The time for a tube to pass through the duct 22 does not influence the loading rate.

The time saved in delivering a tube compared with known devices is about two seconds, this saving being very significant for spinning machines comprising a large number of spinning stations.

The duct 22 can be constructed simply and economically of a flexible material such as natural or synthetic polymer material, e.g. transparent plastic material, thus allowing visual monitoring of its proper operation and providing good adherence for gently locking the tube column. This construction also makes it easier to mount the device and to centre the plant components.

If a deformable material with good elastic return characteristics is used for the duct 22 the stack of tubes can be locked in the embodiment shown in FIG. 2 without providing the slot 30, by simply pressing the member 29 against the duct wall, so deforming it, by squashing sufficiently to prevent the downward sliding of the stack of tubes lying above the pressing point.

Constructing the duct 22 of an elastically deformable material also allows the lower end of the duct to be moved from the normal position used for loading the mobile store, to a different position.

This unusual operation is useful for example when the process is to be changed, and different tubes used. In this case the lower end of the duct 22, but not its shutter, is moved into a position corresponding with a collection bin for the tubes to be discharged. The raising device 20 is then operated with the result that all the tubes upstream of the raising member are made to flow into the bin, so discharging them from the spinning machine.

We claim:

1. A device for loading empty spinning tubes onto pegs of a doffing belt of a spinning machine, comprising: a tube raising member extending above said belt, a tube orienting member operatively positioned over said doffing belt which positions and maintains positioned over said doffing belt which positions and maintains the tubes in a vertical position, and an intermediate storage device between said tube duct and said doffing belt containing movable compartments for receiving a tube in a vertical position in each compartment from the tube duct at a receiving position and for movement of the tube to a transfer position wherein the tube is dischargeable from the compartment in a vertical position onto a receiving peg on the doffing belt.

2. A device according to claim 1, further comprising a lever located at the transfer position, wherein one end of the lever includes a shutter that can open and close the compartment at the transfer position for discharging the tube therefrom onto the receiving peg.

3. A device according to claim 2, wherein the intermediate storage store moves within a container having a fixed outer wall and a fixed base and a belt driven inner wall having separating vanes which form said compartments.

4. A device according to claim 2, wherein the movement of the shutter is opposed by a spring-like member which returns the shutter to a closed position after a sensor-directed opening command has ended.

5. A device according to claim 1, wherein the tube duct is constructed of elastically deformable material.

6. A device according to claim 1, wherein a shutter is interposed between the tube duct and the intermediate storage device, wherein said shutter is adapted for opening thereby allowing a tube to be discharged from the tube duct and wherein said shutter is adapted for closing thereby enabling a column of tubes to be maintained in the tube duct.

7. A device according to claim 6, wherein sensors are provided along the tube duct to control the height of the column of tubes.

8. A device according to claim 7, wherein the sensors activate or deactivate the tube raising member and tube orienting member to maintain a predetermined maximum and minimum number of tubes in the tube duct.

9. A device according to claim 1, wherein the operation of the raising member insures that all of the compartments in the intermediate storage device located between the receiving position and transfer position contain a tube.

10. A device according to claim 1, wherein the transfer position is opened for loading only if sensors have determined that the receiving peg in the doffing belt has not been loaded with a tube.

11. A device according to claim 1, wherein the doffing belt is advanced to a next peg only if sensors have determined that a tube has been correctly loaded on the receiving peg.

* * * * *